US005234617A

United States Patent [19]

Hunter et al.

[11] Patent Number: 5,234,617

[45] Date of Patent: Aug. 10, 1993

[54] AQUEOUS LIQUID BLEACH COMPOSITIONS WITH FLUORESCENT WHITENING AGENT AND POLYVINYL PYRROLIDONE OR POLYVINYL ALCOHOL

[75] Inventors: Kathleen B. Hunter; Edward E. Getty; Josephine L. Kong-Chan, all of Procter & Gamble Company, Ivorydale Technical Center, Cincinnati, Ohio 45217

[73] Assignees: Kathleen B. Hunter; Edward E. Getty; Josephine L. Kong-Chan, all of Cincinnati, Ohio

[21] Appl. No.: 870,842

[22] Filed: Apr. 20, 1992

[51] Int. Cl.[5] ..... C11D 3/37; C11D 3/39; C11D 3/42; C11D 17/08

[52] U.S. Cl. ..... 252/102; 8/111; 8/137; 252/95; 252/173; 252/174.23; 252/186.26; 252/524; 252/542; 252/558; 252/DIG. 2; 252/DIG. 14

[58] Field of Search ..... 252/94, 95, 99, 102, 252/173, 174.23, 186.26, 524, 542, 558, DIG. 2, DIG. 14; 8/111, 137

[56] References Cited

U.S. PATENT DOCUMENTS

| | | | |
|---|---|---|---|
| 2,838,459 | 7/1958 | Sprout, Jr. | 252/186 |
| 3,192,255 | 6/1965 | Cann | 260/502 |
| 3,442,937 | 5/1969 | Sennewald et al. | 260/502 |
| 3,915,903 | 10/1975 | Wise | 252/552 |
| 3,929,678 | 12/1975 | Laughlin et al. | 252/526 |
| 3,996,152 | 12/1976 | Edwards et al. | 252/186 |
| 4,017,411 | 4/1977 | Diehl et al. | 252/186 |
| 4,036,778 | 7/1977 | Lohmann | 252/301 |
| 4,100,095 | 7/1978 | Hutchins | 252/99 |
| 4,232,141 | 11/1980 | Koyanagi et al. | 526/344.2 |
| 4,298,490 | 11/1981 | Lange et al. | 252/91 |
| 4,309,316 | 1/1982 | Lange et al. | 252/543 |
| 4,507,219 | 3/1985 | Hughes | 252/118 |
| 4,561,998 | 12/1985 | Wertz et al. | 252/547 |
| 4,634,551 | 1/1987 | Burns et al. | 252/102 |
| 4,642,198 | 2/1987 | Humphries . | |
| 4,681,592 | 7/1987 | Hardy et al. | 8/111 |
| 4,686,063 | 8/1987 | Burns | 252/102 |
| 4,758,369 | 7/1988 | Dryoff et al. | 252/94 |
| 4,764,302 | 8/1988 | Baker et al. | 252/301 |
| 4,822,510 | 4/1989 | Madison et al. | 252/95 |
| 4,824,591 | 4/1989 | Dryoff et al. | 252/94 |
| 4,828,747 | 5/1989 | Rerek et al. | 252/95 |
| 4,852,989 | 8/1989 | Burns et al. | 8/107 |
| 4,853,143 | 8/1989 | Hardy et al. | 252/102 |
| 4,879,057 | 11/1989 | Dankowski et al. | 252/99 |
| 4,909,953 | 3/1990 | Sadlowski | 252/99 |
| 4,929,283 | 5/1990 | Haendler | 252/187.26 |
| 5,004,558 | 4/1991 | Dryoff et al. | 252/95 |
| 5,035,825 | 7/1991 | Eckhardt et al. | 252/95 |
| 5,055,218 | 10/1991 | Getty et al. | 252/94 |
| 5,091,106 | 2/1992 | Jacobs et al. | 252/186.26 |
| 5,126,066 | 6/1992 | Torenbeek et al. | 252/95 |

FOREIGN PATENT DOCUMENTS

| | | |
|---|---|---|
| 0160342 | 6/1985 | European Pat. Off. . |
| 0176124 | 4/1986 | European Pat. Off. . |
| 0240481 | 10/1987 | European Pat. Off. . |
| 0267175 | 11/1988 | European Pat. Off. . |
| 0347988 | 12/1989 | European Pat. Off. . |
| 0468103A1 | 1/1992 | European Pat. Off. . |
| WO91/09103 | 6/1991 | PCT Int'l Appl. . |
| 1535804 | 12/1978 | United Kingdom . |

OTHER PUBLICATIONS

Copending U.S. patent application Ser. No. 656,396 (P&G Case 4337), filed Feb. 15, 1991.

*Primary Examiner*—Dennis Albrecht
*Attorney, Agent, or Firm*—Kathleen M. Harleston; Donald E. Hasse; Ronald L. Hemingway

[57] ABSTRACT

An aqueous liquid bleach composition containing solid, water-insoluble organic peroxyacid, bleach-stable, stilbene fluorescent whitening agent, and polyvinyl pyrrolidone or polyvinyl alcohol is provided.

A preferred aqueous liquid bleach composition comprising, by weight of the composition, from 5 to 15 weight % of mononylamido peroxyadipic acid; from about 0.4 to about 10 weight % of polyvinyl pyrrolidone with a molecular weight between about 5,000 and about 100,000; and from about 0.05 to about 2 weight % of a fluorescent whitening agent of the formula:

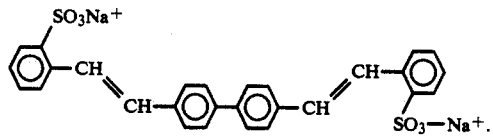

Preferably, the ratio of polyvinyl pyrrolidone to fluorescent whitening agent is between about 20:1 and about 1:1 and the composition has a pH at 20° C. from about 1 to about 6.5.

15 Claims, No Drawings

AQUEOUS LIQUID BLEACH COMPOSITIONS WITH FLUORESCENT WHITENING AGENT AND POLYVINYL PYRROLIDONE OR POLYVINYL ALCOHOL

TECHNICAL FIELD

The present invention relates to aqueous liquid bleach compositions which contain solid, substantially water-insoluble organic peroxyacid, bleach-stable, stilbene fluorescent whitening agent (FWA), and polyvinyl pyrrolidone (PVP) or polyvinyl alcohol (PVA) for an enhanced whitening and brightening effect. The ratio of PVP:FWA is between about 100:1 and about 1:1, the ratio of PVA:FWA is between about 20:1 and about 1:1, and the compositions have a pH of from about 1 to about 6.5.

BACKGROUND OF THE INVENTION

Bleaching detergents containing stilbene fluorescent whitening agent (FWA) are disclosed, for example, in U.S. Pat. No. 5,035,825, Eckhardt et al, issued Jul. 30, 1991.

Aqueous liquid bleach compositions containing solid, substantially water-insoluble organic peroxyacid are disclosed in, for example, U.S. Pat. No. 4,828,747, Rerek et al, issued May 9, 1989.

U.S. Pat. Nos. 4,309,316 and 4,298,490, Lange et al, issued Jan. 5, 1982 and Nov. 3, 1981, respectively, disclose processes for the production of washing powders which contain certain FWAs.

U.S. Pat. No. 4,879,057, Dankowski et al, issued Nov. 7, 1989, discloses aqueous bleaching agent suspensions based on a water-soluble peroxycarboxylic acid suspended in a carrier liquid in the presence of an organic thickening agent and an acidifying agent.

It has now been found that PVP and/or PVA and bleach-stable, stilbene FWA can be included in an aqueous liquid bleach composition containing solid, substantially water-insoluble organic peroxyacid for an enhanced whitening and/or brightening effect. The PVP or PVA and FWA need not be pre-mixed before addition to the bleach composition.

It has now been found that xanthan gum and nonionic or anionic surfactant in the present compositions, where the peroxyacid is amidoperoxyacid and alkali earth salts are included, allows the formulation of a product which shows surprising stability. In this formulation, PVP is included, but PVA and cellulosic derivatives are not included. These compositions are storage-stable and pourable.

SUMMARY OF THE INVENTION

The present invention relates to an aqueous liquid bleach composition comprising, by weight:

(a) from about 1% to about 40% of solid, substantially water-insoluble organic peroxyacid;

(b) from about 0.2% to about 20% of polyvinyl pyrrolidone or polyvinyl alcohol with a molecular weight between about 4,000 and about 200,000;

(c) from about 0.01% to about 5% of bleach-stable, stilbene fluorescent whitening agent; and wherein the ratio of polyvinyl pyrrolidone to fluorescent whitening agent is between about 100:1 and about 1:1, or the ratio of polyvinyl alcohol to fluorescent whitening agent is between about 20:1 and about 1:10; and the composition has a pH at 20° C. from about 1 to about 6.5.

DETAILED DESCRIPTION OF THE INVENTION

The present invention is an aqueous liquid bleach composition comprising solid, substantially water-insoluble organic peroxyacid, polyvinyl pyrrolidone (PVP) and/or polyvinyl alcohol (PVA), and bleach-stable, stilbene fluorescent whitening agent (FWA).

Compositions of the present invention are useful for bleaching fabrics, hard surfaces and other substrates. Preferred compositions herein exhibit good physical, chemical and rheological stability. They preferably have a viscosity of from about 10 to about 1000, preferably from about 50 to about 800, most preferably from 80 to 450, cps at 20° C. Viscosity is measured by an RVT Brookfield Viscometer using a No. 3 spindle and a setting of 100 rpm. Low viscosity is desirable for convenient pouring of the product from a container.

The present liquid bleach compositions can be used in conjunction with a separate cleaning composition such as a laundry detergent composition separately added to a laundering solution, e.g. in the washing machine. They can alternatively be used as an element of a laundry detergent or cleaning composition.

Liquid bleach compositions herein can contain any of the optional ingredients known for use in such compositions. The balance of the composition should be water, preferably distilled and deionized water. Water containing heavy metals is undesirable because peroxyacids exposed to metals are subject to the loss of available oxygen and will lose bleaching activity. Preferably, the compositions contain from about 20 to about 90, preferably from about 40 to about 80, weight % of water.

The PVP:FWA ratio in the present composition is between about 100:1 and about 1:1, preferably between about 20:1 and about 1:1, most preferably between 10:1 and 3:1. The PVA:FWA ratio in the present composition is between about 20:1 and about 1:10, preferably between about 10:1 and about 1:5, most preferably between 3:1 and 1:3.

Organic Peroxyacid

The compositions of the present invention contain from about 1 to about 40, preferably from about 2 to about 30, more preferably from about 4 to about 20, most preferably from 5 to 15, weight % of solid, substantially water-insoluble organic peroxyacids.

The organic peroxyacid should be evenly suspended throughout the liquid bleach composition.

The following organic peroxyacids are preferred: 4-nonylamino-4-oxoperoxybutyric acid; 6-nonylamino-6-oxoperoxyhexanoic acid; 1,12-diperoxydodecanedioic acid,; heptyl sulfonylperpropionic acid; decylsulphonyl perpropionic acid; and heptyl-, octyl-, nonyl-, and decyl-sulphonylperbutyric acid. Most preferred are 4-nonylamino-4-oxoperoxybutyric acid, and 6-nonylamino-6-oxoperoxyhexanoic acid.

Of the organic peroxyacids, amidoperoxyacids (amide substituted peroxycarboxylic acids) are preferred. Suitable amidoperoxyacids for use herein are described in U.S. Pat. Nos. 4,634,551 and 4,686,063, both Burns et al, issued Jan. 6, 1987 and Aug. 11, 1987, respectively, both incorporated herein by reference. Suitable amidoperoxyacids are of the formula:

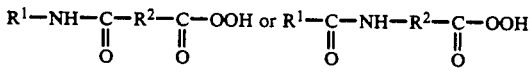

wherein $R^1$ is an alkyl group containing from about 6 to about 12 carbon atoms, and $R^2$ is an alkylene containing from 1 to about 6 carbon atoms. Preferably, $R^1$ is an alkyl group containing from about 8 to about 10 carbon atoms, and $R^2$ is an alkylene group containing from about 2 to about 4.

More preferred are peroxyfumarates, which are described in U.S. Pat. No. 4,852,989, Burns et al, issued Aug. 1, 1989, incorporated herein by reference, and sulfone peroxyacids (sulfone peroxycarboxylic acids), which are described in U.S. Pat. Nos. 4,758,369, 4,824,591, and 5,004,558, all Dryoff et al, issued Jul. 19, 1988, Apr. 25, 1989, and Apr. 2, 1991, respectively, all incorporated herein by reference.

The most preferred amidoperoxyacids are monononylamido peroxyadipic acid (NAPAA) and monononylamido peroxysuccinic acid (NAPSA). Another name for NAPAA is 6-(nonylamino)-6-oxocaproic acid. The chemical formula for NAPAA is;

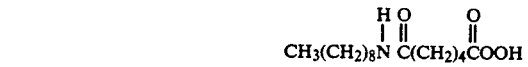

The molecular weight of NAPAA is 287.4.

Example I of U.S. Pat. No. 4,686,063 contains one description of the synthesis of NAPSA, from column 8, line 40 to Column 9, line 5, and NAPAA, from column 9, line 15 to column 9, line 65. At the end of the amidoperoxyacid synthesis, the reaction is quenched with water, filtered, washed with water to remove some excess sulfuric acid (or other strong acid with which the peroxyacid was made), and filtered again.

The amidoperoxyacid wet cake thus obtained can be contacted with a phosphate buffer solution at a pH between about 3.5 and 6, preferably between about 4 and 5, according to U.S. Pat. No. 4,909,953, Sadlowski et al, issued Mar. 20, 1990, which is incorporated herein by reference.

Other agents for storage stabilization or exotherm control can be added to the amidoperoxyacid before incorporation into the final product. For example, boric acid, an exotherm control agent disclosed in U.S. Pat. No. 4,686,063, Burns, issued Aug. 11, 1987 and incorporated herein, can be mixed with the amidoperoxyacid (which has been washed in phosphate buffer) in about a 2:1 peracid:boric acid ratio. The phosphate buffer washed amidoperoxyacid can also be mixed with appropriate amounts of dipicolinic acid and tetrasodium pyrophosphate, a clelating stabilization system. Chelants can optionally be included in the phosphate buffer before contact with the wet cake.

NAPAA can be prepared by, for example, first reacting NAAA (monononyl amide of adipic acid), sulfuric acid, and hydrogen peroxide. The reaction product is quenched by addition to ice water followed by filtration, washing with distilled water, and final suction filtration to recover the wet cake. Washing can be continued until the pH of the filtrate is neutral.

Small particle size NAPAA agglomerates are desired hereinto increase the amount of effective bleach which is in the wash solution and thereby improve bleaching/cleaning of fabrics in the wash. This is particularly useful in a hard water wash, i.e. wash water with more than about 6 grains of hardness, because hardness, specifically calcium ions, has been seen to interfere with available oxygen (AvO) from NAPAA with larger particle size. While not meaning to be bound by theory, it is believed that the calcium ions in the hard water surround large NAPAA particles, i.e. greater than about 300 microns, and interfere with the dissolution of the NAPAA, and that the smaller (about 0.1–260 microns) NAPAA particles dissolve rapidly in the wash water with minimal interference from the hardness ions. Small NAPAA particles are preferably obtained by quenching in water with high shear applied, e.g. rapid stirring, during addition of the NAPAA solution to water. Other known means of achieving small particle size may be used as appropriate. The NAPAA is then rinsed with water to remove excess sulfuric acid.

The average particle size of the NAPAA (or NPASA) herein is 0.1 to 260 microns and is in large part a function of the amount of shear applied. The average particle size is preferably from about 10 to 100 microns, and most preferably from about 30 to about 60 microns.

NAPAA filter cake herein is preferably washed twice in phosphate buffer. It has been found that two successive phosphate buffer washes lend optimal stability to NAPAA.

Preferred NAPAA is thermally annealed (or thermally agglomerated), meaning that it has been heated up to 70° C. and then quenched and filtered. This process causes NAPAA to grow into a new crystal morphology. These new NAPAA crystals are sheared to an average particle size of about 30–60 microns and are less readily soluble in the bleach product, thus resulting in a more stable product.

Particulate (solid), organic peroxyacids with a theoretical AvO (available oxygen) of between about 3 and about 12, most preferably between 5 and 7, are preferred.

Polyvinyl Pyrrolidone and Polyvinyl Alcohol

The second required ingredient(s) of the present composition is from about 0.2 to about 20, preferably from about 0.4 to about 10, more preferably from about 0.5 to about 5, most preferably from 1 to 2, weight % polyvinyl pyrrolidone (preferred) and/or polyvinyl alcohol. The PVP, which includes substituted and unsubstituted vinyl pyrrolidone polymerization products, and PVA have a molecular weight between about 4,000 and about 200,000, preferably between about 5,000 and about 100,000 most preferably between 10,000 and 30,000.

PVP is most preferred in the liquid bleach composition. A combination of PVPs and/or PVAs of different molecular weights could also be used. The minimum amount of PVP/PVA which will achieve the benefit should be used since excess PVP/PVA can result in redeposition on the fabric. Generally, the higher the molecular weight of the PVP/PVA is, the less PVP/PVA is needed. The amount of PVP/PVA used also depends upon the FWA used.

The PVP and/or PVA are preferably incorporated into the composition by mixing into the formula with mechanical agitation until substantially dispersed.

Fluorescent Whitening Agent

The third required ingredient of the liquid bleach composition herein is from about 0.01 to about 5, preferably from about 0.05 to about 2, most preferably from 0.1 to 1, weight % of bleach-stable, stilbene fluorescent whitening agent (FWA). Stilbene FWAs are aromatic compounds with two aryl groups separated by an alkene chain. They preferably have the following structural formula:

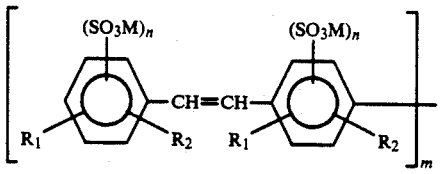

wherein $R_1$ is hydrogen, halogen, alkyl, alkoxy or phenyl;

$R_2$ is hydrogen or alkyl;

M is hydrogen, an alkali metal or ammonium ion;

n=0–2, but the formula must contain at least one $SO_3M$ group; and m=1–2 and when m=1, the substituent on the linkage carbon is hydrogen.

Suitable stilbene FWAs for use herein, if they are bleach-stable, are as described in U.S. Pat. Nos. 4,309,316 and 4,298,490, Lange et al, issued Jan. 5, 1982 and Nov. 3, 1981, respectively, both incorporated by reference, and U.S. Pat. No. 5,035,825, Eckhardt et al, issued Jul. 30, 1991, also incorporated herein by reference.

Bleach-stable anionic FWAs with sulfonic acid group(s) which work on cotton (cellulosics) are preferred.

The most preferred stilbene FWA for use herein, because it is bleach-stable, is Tinopal ® CBS-X, which is benzensulfonic acid, 2,2'-((1,1'-biphenyl)-4,4'-diyldi-2,1-ethendiyl)bis-, disodium salt (CA Index Name). The formula for Tinopal ® CBS-X is:

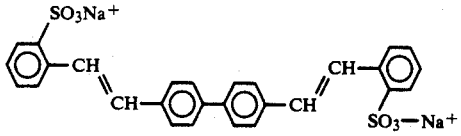

The FWA is preferably dissolved or dispersed in the liquid bleach composition, preferably after the peroxyacid and PVP or PVA is mixed into water.

Optional Anionic or Nonionic Surfactant

A preferred optional ingredient in the present liquid bleach composition is from 0.1 to 2, preferably about 0.2 to about 1.5, most preferably 0.5 to 1.0, weight % of anionic and/or nonionic surfactant. These are preferably selected from the group consisting of $C_{9-20}$ linear alkylbenzene sulfonate, $C_{12-20}$ alkyl sulfate, $C_{12-20}$ alkyl ether sulfate, $C_{8-18}$ alkenyl carboxysulfonate, $E_{2-20}$ ethoxylated $C_{10-20}$ alcohols, polyhydroxy fatty acid amide, and mixtures thereof. More preferred are $C_{10-14}$ linear alkylbenzene sulfonate (most preferred), $E_{2-5}$ ethoxylated $C_{12-18}$ alcohols, and/or polyhydroxy fatty acid amide.

This low level of surfactant is preferred for wetting and dispersal of the organic peroxyacid, particularly the amidoperoxyacid, in the liquid composition. It is believed that the surfactant is not present in an amount sufficient to act as a structurant. It is instead present in an amount less than or equal to 2, preferably less than or equal to about 1.5, weight %.

1. Anionic Surfactant

Anionic surfactants useful for detersive purposes are included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids prepared by sulphonation of the pyrolyzed product of alkaline earth metal citrates, e.g., as described in British Patent Specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters, N-acyl sarcosinates, sulfates of alkylpolysacharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO^-M^+$ where R is a $C_8$–$C_{22}$ alkyl, k is an integer from 0 to 10, and M is a soluble salt-forming cation, and fatty acids esterified with isothionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al., at Column 23, line 58 through Column 29, line 23 (herein incorporated by reference).

One type of anionic surfactant preferred for liquid detergent compositions herein is alkyl ester sulfonates. These are desirable because they can be made with renewable, non-petroleum resources. Preparation of the alkyl ester sulfonate surfactant component is according to known methods disclosed in the technical literature. For instance, linear esters of $C_8$–$C_{20}$ carboxylic acids can be sulfonated with gaseous $SO_3$ according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

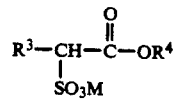

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quarternary ammonium cations, e.g. tetramethyl-ammonium and dimethyl piperydinium, and cations derived from alkanolamines, e.g. monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{14}$–$C_{16}$ alkyl.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium potassium, lithium), substituted or unsubstituted ammonium cations such as methyl-, dimethyl-, and trimethyl ammonium and quarternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12}$–$C_{16}$ are preferred for lower wash temperatures (e.g., below about 50° C.) and $C_{16}$–$C_{18}$ alkyl chains are preferred for higher wash temperatures (e.g., above about 50° C.).

Alkyl alkoxylated sulfate surfactants are another category of useful anionic surfactant. These surfactants are water insoluble salts or acids typically of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperdyninium and cations derived from alkanolamines, e.g. monoethanolamine, diethanolamine, and triethanolamine, and mixtures thereof. Exemplary surfactants are $C_{12}$–$C_{18}$ alkyl polyethoxylate (1.0) sulfate, $C_{12}$–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

Preferred for use in liquid detergent compositions herein are $C_{12}$–$C_{20}$ alkyl sulfate, $C_{12}$–$C_{20}$ alkyl ether sulfate and/or $C_9$–$C_{20}$ linear alkylbenzene sulfonate (preferably sodium salts). Preferably the nonionic surfactant is the condensation product of $C_{10}$–$C_{20}$ alcohol and between about 2 and about 20 moles of ethylene oxide per mole of alcohol ("$E_{2-20}$ ethoxylated $C_{10-20}$ alcohol"), or polyhydroxy $C_{10-20}$ fatty acid amide.

2. Nonionic Surfactant

Suitable nonionic detergent surfactants are generally disclosed in U.S. Pat. No. 3,929,678, Laughlin et al., issued Dec. 30, 1975, at column 13, line 14, through column 16, line 6, incorporated herein by reference. Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. These compounds are commonly referred to as alkyl phenol alkoxylates, (e.g., alkyl phenol ethoxylates).

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. This category of nonionic surfactant is referred to generally as "alkyl ethoxylates."

3. The condensation products of ethylene oxide with a hydrophobic base formed by the condensation of propylene oxide with propylene glycol.

4. The condensation products of ethylene oxide with the product resulting from the reaction of propylene oxide and ethylenediamine.

5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms, and a moiety selected from the group consisting of alkyl and hydroxyalkyl moieties of from about 1 to about 3 carbon atoms.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units.

7. Fatty acid amide surfactants having the formula:

$$R^6-\overset{\overset{\displaystyle O}{\|}}{C}-N(R^7)_2$$

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

3. Polyhydroxy Fatty Acid Amide Nonionic Surfactant

The liquid detergent compositions hereof preferably contain an "enzyme performance-enhancing amount" of polyhydroxy fatty acid amide surfactant. By "enzyme-enhancing" is meant that the formulator of the composition can select an amount of polyhydroxy fatty acid amide to be incorporated into the composition that will improve enzyme cleaning performance of the detergent composition. In general, for conventional levels of enzyme, the incorporation of about 1%, by weight, polyhydroxy fatty acid amide will enhance enzyme performance.

The compositions hereof will typically comprise at least about 1 weight % polyhydroxy fatty acid amide surfactant and preferably will comprise from about 3% to about 50%, most preferably from about 3% to about 30%, of the polyhydroxy fatty acid amide.

The polyhydroxy fatty acid amide surfactant component comprises compounds of the structural formula:

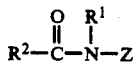

(I)

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

Alkenyl carboxysulfonates (ACS) are multifunctional developmental detergent additives. They contain two anionic functions, sulfonate and carboxylate, as well as an ester or an amide. They are made from the reaction of alkenylsuccinic anhydrides with either sodium isothionate or sodium N-methyltaurine. The structural formula for ACS is:

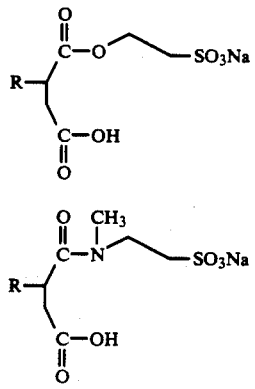

where the alkenyl group in the ACS is in the range of $C_8$ to $C_{18}$.

Optional Alkaline Earth Salts

A second preferred ingredient for use herein is from about 3 to about 30, preferably from about 5 to about 25, most preferably from 7 to 15, weight % of alkali metal and alkaline earth salts of sulfate, nitrate, and/or borate. Preferred are magnesium, sodium and/or potassium sulfate and/or borate. More preferred are magnesium sulfate, sodium sulfate and/or potassium sulfate. From 5 to 10 weight % of sodium sulfate and from 3 to 6 weight % of magnesium sulfate are highly preferred (calculated from the anhydrous weight).

These electrolytes are believed to improve the physical and chemical stability of the composition. Hydrate forming neutral salts desensitize peroxycarboxylic acids upon spillage and/or drying. Thus the safety during handling and marketing is increased. Magnesium sulfate in particular is added for safety since it may function as an exotherm control agent. The salt(s) will increase the density of the aqueous liquid compositions herein, and may act as dispersing agent(s).

The salt(s) can be mixed into the composition in any order of addition, preferably after the water, peroxyacid, surfactant and chelant are mixed together. The salt(s) should be substantially solubilized or dissolved into the aqueous liquid composition.

Optional Xanthan Gum

A third preferred ingredient is from about 0.05 to about 3, more preferably from about 0.1 to about 1, most preferably from 0.15 to 0.2, weight % of xanthan gum. Xanthan gum is a polysaccharide used herein as a dispersing agent and stabilizer. It is produced by fermentation and extraction of the naturally occurring plant bacteria, *Xanthomonas campestrias.*

Xanthan gum and surfactant in the present compositions, where the peroxyacid is amidoperoxyacid and alkali earth metal salts are included, allow the formulation of a product which shows surprising stability. In this preferred formulation, PVP is included, but PVA and cellulosic derivatives are not included. The compositions are storage-stable and pourable for months.

Optional Chelants

A fourth preferred ingredient for use in the present compositions is from about 0.005 to about 1.0, preferably from about 0.01 to about 0.5, most preferably from 0.05 to 0.3, weight % of chelant. Chelants are added because the peroxyacids are subject to the loss of available oxygen when contacted by heavy metals.

Examples of suitable chelants for use herein are: carboxylates, such as ethylene diamine tetraacetate (EDTA) and diethylene triamine pentaacetate (DTPA); polyphosphate, such as sodium acid pyrophosphate (SAPP), tetrasodium pyrophosphate (TSPP), and sodium tripolyphosphate (STPP); phosphonates, such as ethylhydroxydiphosphonate (Dequest® 2010) and other sequestering agents sold under the Dequest® trade name; and combinations of the above. Other sequestering agents for use herein are dipicolinic acid (2,6 pyridinedicarboxylic acid), picolinic acid, and 8-hydroxyquinoline, and combinations thereof.

The chelating agent can be any of those described above or described in U.S. Pat. No. 3,442,937, issued May 6, 1969 to Sennewald et al., U.S. Pat. No. 2,838,459, issued Jul. 10, 1958 to Sprout, Jr., and U.S. Pat. No. 3,192,255, issued Jun. 29, 1965 to Cann, incorporated herein by reference. Preferred chelating agents are picolinic acid, dipicolinic acid, and ethylhydroxydiphosphonate.

Optional Hydrotropes

Hydrotropes such as sodium, potassium, and ammonium xylene sulfonate, sodium, potassium and ammonium toluene sulfonate, sodium, potassium and ammonium cumene sulfonate, and mixtures thereof, and related compounds (as disclosed in U.S. Pat. No. 3,915,903, incorporated herein by reference) can be utilized in the interests of achieving a desired product phase stability and viscosity. Hydrotropes useful in the compositions of the present invention are typically present at levels of from about 0.5% to about 10%, preferably from about 1% to about 5%, by weight. Sodium toluene sulfonate is preferred.

Optional pH Adjusting Agents

The composition of the present invention has a pH at 20° C. of from about 1 to about 6.5, preferably from about 2.5 to about 5.5, most preferably from 3.5 to 4.5.

To obtain the desired product pH, conventional pH adjusting agents are used. From about 5 to about 20, preferably from 10 to 15, weight % of sodium hydroxide (calculated on a 0.5N basis) is preferred.

Optional Perfume

The compositions of the present invention may also comprise from about 0.01% to about 1%, preferably from about 0.05% to about 0.5%, preferably from about 0.1% to about 0.3%, by weight of a perfume comprising perfume ingredients selected from the group consisting of dodecahydrotetramethylnapthofuran, methyl-2,2-dimethylbicyclo-(2,2,1)-heptane-3-carboxylate, 4-isopropylbenzonitrile, 2-heptyltetra- hydrofuran, 2-methyl-decanonitrile, 3,5,5-trimethylhexylacetate, 2-4-dimethyl-6-phenyldihydropyran, 2,4,dimethyl-4-phenyl tetrahydrofuran, 5-acetyl-3-isopropyl-1,1,2,6-tetramethylindane, phenylethyl iso-pentyl-ether, phenylethyl n-butyl ether, 3-methyldodecanonitrile, 2-tertiarybutylcyclohexyl acetate, tridecene-2-nitrile, amyl salicylate, fenchyl alcohol, iso bornyl acetate, 2-methyl-3-(2-pentenyl)-2-cyclopenten-1-one, methyl cedrylone, bicyclo(2,2,2)heptane,2-ethyl-5-methoxy, Cistus Biocolorless (a natural extract available from Biolandes Technologies), 3-cyclopentene-1-acetonitrile,2,2,3-trimethyl, cyclohexanepropanol, 2,2,6-trimethyl-alpha-propyl, and 1,3-dioxolane,2-hexyl.

Particularly preferred perfumes herein comprise perfume ingredients selected from the group consisting of methyl-2,2-dimethylbicyclo-(2.2.1)-heptane-3-carboxylate, 4-isopropylbenzonitrile, 2-heptyltetrahydrofuran, 2-methyl-decanonitrile, 3,5,5-trimethylhexylacetate, 2-4-dimethyl-6-phenyldihydropyran, 2,4, dimethyl-4-phenyl tetrahydrofuran, phenylethyl iso-pentyl-ether, phenylethyl n-butyl ether, 3-methyldodecanonitrile, 2-tertiarybutylcyclohexyl acetate, tridecene-2-nitrile, amyl salicylate, fenchyl alcohol, iso bornyl acetate, methyl cedrylone, bicyclo (2.2.1) heptane,2-ethyl-5-methoxy, Cistus Biocolorless, and cyclohexanepropanol,2,2,6-trimethyl-alpha-propyl.

Of the above, particularly preferred perfume ingredients include 4-isopropylbenzonitrile, 2-methyl-decanonitrile, 2-4-dimethyl- 6-phenyldihydropyran, 2,4,dimethyl-4-phenyl tetrahydrofuran, phenylethyl n-butyl ether, 3-methyldodecanonitrile, tridecene-2-nitrile, fenchyl alcohol, iso bornyl acetate, bicyclo (2,2,1) heptane, 2-ethyl-5-methoxy, Cistus Biocolorless, and cyclohexanepropanol,2,2,6-trimethyl-alpha-propyl.

Particularly preferred perfumes herein comprise at least about 30%, preferably at least about 40%, and more preferably at least about 50% by weight of the above stable perfume ingredients.

Other Optional Ingredients

Other desirable optional ingredients include bleach-stable enzymes and dyes and colorants. Chloride should be excluded from the compositions herein.

From about 0.01 to about 5, preferably from about 0.1 to about 2.5, weight % of bleach-stable enzymes are desirably included herein. Suitable enzymes include protease, lipase, amylase, cellulase, and mixtures thereof, which are commercially available.

The ingredients herein should be combined in any manner which will evenly disperse or dissolve them in the composition, and which does not interfere with their action. Preferably, the ingredients are added to a mixer while stirring. The preferred order of addition is: water, peroxyacid, chelant, surfactant, salts, hydrotrope, PVP, FWA, xanthan gum, pH adjusting agent, water to balance and perfume.

An aqueous liquid bleach composition which is physically, chemically and rheologically stable (preferred embodiment herein) can be formulated by including the following, by weight of the composition:

a. 0.05–3% xanthan gum;
b. 5–15% amidoperoxyacid of average particle size from about 30 to about 60 microns;
c. 0.2–1.5% nonionic or anionic surfactant;
d. 0.01–0.5% chelant;
e. 7–15% sodium sulfate and magnesium sulfate;
f. 1–5% hydrotrope;
g. 0.5–5% PVP with molecular weight between 10,000 and 20,000;
h. 0.05–2% FWA Tinopal ® CBS-X of the formula:

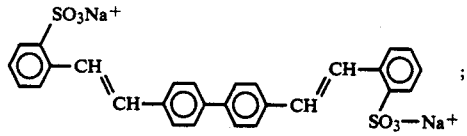

; and i. balance distilled deionized water;

wherein the pH at 20° C. of the composition is between 3.5 and 4.5.

A sufficient amount of sodium hydroxide (0.5N) is added (usually 10–15 weight %) just before balancing with water to bring the pH of the composition at 20° C. to between 3.5 and 4.5. These ingredients should be mixed together in the above order of addition beginning with part of the water. PVA and cellulosic derivatives are preferably excluded, as is chloride.

The bleach additive herein can be used with a hard surface cleaning composition. Ordinarily, a conventional hard surface cleaner would be added at the recommended level to, for example, 2 gallons of water. From about 10 to about 100 milliliters of the bleach additive would then be added to the water, and the hard surface would be washed or scrubbed.

Bleaching compositions of the present invention are utilized by adding them to water in an amount sufficient to provide from about 1 ppm to 100 ppm, preferably from about 1 ppm to 20 ppm, of available oxygen in solution. Fabrics (or hard surfaces) to be bleached are then contacted with such aqueous bleaching solutions.

This invention further provides a method for cleaning and bleaching fabrics in the wash by contacting the fabrics with effective amounts of a detergent cleaning composition and an aqueous liquid bleach composition comprising, by weight:

(a) from about 1% to about 40% of solid, substantially water-insoluble organic peroxyacid;

(b) from about 0.2% to about 20% of polyvinyl pyrrolidone or polyvinyl alcohol with a molecular weight between about 4,000 and about 200,000;

(c) from about 0.01% to about 5% of bleach-stable, stilbene fluorescent whitening agent; and wherein the ratio of polyvinyl pyrrolidone to fluorescent whitening agent is between about 100:1 and about 1:1, or the ratio of polyvinyl alcohol to fluorescent whitening agent is between about 20:1 and about 1:10; and the composition has a pH at 20° C. of from about 1 to about 6.5.

Preferably the aqueous liquid composition used in the preferred method for cleaning and bleach fabrics comprises ingredients a-i above. Agitation is preferably provided for enhanced bleaching.

The compositions of the present invention can be used in conjunction with conventional liquid or granular detergent compositions. Such compositions can contain standard detergent ingredients, such as the surfactants and builders described in U.S. Pat. No. 4,100,095, Hutchins et al., issued Jul. 11, 1978, incorporated herein by reference. Other detergent compositions that can be used with the compositions herein are described in U.S. Pat. No. 4,561,998, Wertz, et al., issued Dec. 31, 1985, U.S. Pat. No. 4,507,219, Hughes, issued Mar. 26, 1985, and U.S. Pat. No. 4,909,953, Sadlowski et al, issued Mar. 20, 1990, all incorporated herein by reference. Preferred fabric laundering granular detergent compositions are described in U.S. Pat. No. 4,909,953, column 8, lines 45–55 and U.S. Pat. No. 5,055,218, Getty et al, issued Oct. 8, 1991, columns 10–14, incorporated herein by reference. Preferably, the detergent composition is used at its recommended level, usually ¼–1 cup for granular compositions. The bleach additive herein is preferably added to the wash at about the same time as the detergent is added. From about 10 to about 150, preferably about 50 to about 100, milliliters of bleach additive is added to about 18 gallons of wash water.

The following examples illustrate the compositions of the present invention, but are not necessarily means to limit or otherwise define the scope of the invention.

All parts, percentages and ratios used herein are by weight unless otherwise specified.

EXAMPLE I

A freshly-prepared ample of NAPAA wet cake is typically about 60% water, about 2% peroxyacid available oxygen (AvO) (corresponding to about 36% NAPAA), and the rest (about 4%) unreacted starting material. This wet cake is the reaction product of NAAA (monononyl amide of adipic acid), sulfuric acid, and hydrogen peroxide. The crude reaction product from the chemical reaction is quenched by addition to water followed by filtration, washing with distilled water, phosphate buffer washing and final suction filtration to recover the wet cake. The wet cake is redispersed in a 1.7% phosphate buffer solution at a 5:1 buffer solution to NAPAA wet cake weight ratio. With stirring, the slurry is heated to 70° C. and held at 70° C. for 10 minutes before quenching with deionized distilled water to about 50° C. or lower. The thermally annealed NAPAA solid is then obtained by suction filtration.

EXAMPLE II

The following composition is prepared by high speed mixing, in a mixing vessel (4L beaker), of the thermally annealed NAPAA (64% active) of Example I into water. The other components are added in the order listed and at the indicated time (approximate) after turning on the high speed mixer.

| Component | Gms | Weight % | Time |
|---|---|---|---|
| Distilled, deionized water | 1052 | 52.30 | 0 minutes |
| Thermally annealed NAPAA | 320 | 10.14 | 0 minutes |
| $C_{12-13}$ Linear alkylbenzene sulfonate | 20.83 | 1.0 | 1 minutes |
| 2,6 Pyridinedicarboxylic acid Sulfonic acid | 5.0 | 0.25 | 3 minutes |
| Sodium sulfate | 149.65 | 7.46 | 5 minutes |
| Magnesium sulfate *7 $H_2O$ | 133.50 | 3.26 | 20 minutes |
| Sodium toluene sulfonate | 34.62 | 1.61 | 25 minutes |
| Xanthan gum | 3.0 | 0.15 | 30 minutes |
| Polyvinyl pyrrolidone (MW 10,000) | 37.80 | 1.89 | 41 minutes |
| FWA (Tinopal ® CBS-X) | 2.0 | 0.1 | 42 minutes |

After 50 minutes, the pH of composition is determined to be 2.3 at room temperature. Sodium hydroxide solution (0.5N) is added with stirring to adjust the pH to 4.5.

The slurry mix is then subjected to high shear mixing for 5 minutes. The pH is again determined to be 4.5 and the balance of water is added. The composition is a stable suspension of ingredients having a viscosity of 97 cps at room temperature and containing 9.71% NAPAA. The average particle size of NAPAA is determined to be about 34 microns.

EXAMPLE III

This experiment shows that panelists visually prefer liquid bleach samples containing polyvinyl pyrrolidone ("PVP") and bleach-stable, stilbene fluorescent whitening agent (FWA Tinopal ® CBS-X) for whiteness and brightness.

Five liquid bleach samples are prepared as follows:

| | Weight % |
|---|---|
| Water (distilled and deionized) | 20.00 |
| Mononononylamido peroxyadipic acid | 10.19 |
| $C_{12-13}$ Linear alkylbenzene sulfonic acid | 1.00 |
| 2,6-Pyridinedicarboxylic acid | 0.25 |
| Sodium sulfate | 8.30 |
| Magnesium sulfate*7$H_2O$ | 7.41 |
| Sodium toluene sulfonate | 1.73 |

Components are added in the order shown above and mixed during addition using a mechanical mixer. The following ingredients are then added, while mixing, to the above formula:

Sample A = no PVP, no FWA
Sample B = 1 wt. % PVP*
Sample C = 0.1 wt. % FWA Tinopal ® CBS-X
Sample D = 1 wt. % PVP*, 0.1 wt. % FWA Tinopal ® CBS-X -continued

| Sample E = 1 wt. % PVP*, 0.1 wt. % FWA2** |
|---|

*Molecular weight of 10,000
**FWA2 is Calcofluor ® White CG.

Each sample is pH adjusted to pH 4.5 using 0.5N sodium hydroxide. Water is added while mixing to bring the total for each sample to 100 grams.

Each sample is then put in a vial and graded (unidentified) by 10 panelists. Panelists are asked to compare vial contents for whiteness and brightness and assign grades according to the following scale:

0=no difference between two samples
1=think there is a difference
2=know there is a little difference
3=know there is a lot of difference
4=know there is a whole lot of difference Each panelists grades under standard lighting and under ultraviolet (UV) lighting. Grades are then averaged and normalized.

Results: Results, which are zeroed to A (control), are as follows:

Graph 1: Visual Preference in Standard Lighting

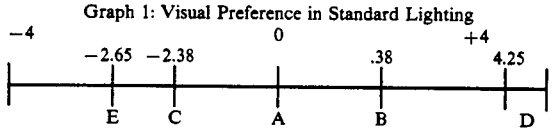

Graph 2: Visual Preference in UV Lighting

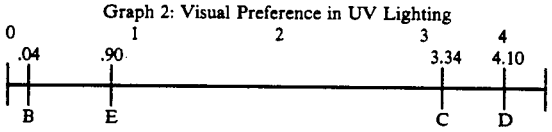

Conclusion: The results show that liquid bleach with PVP+FWA Tinopal ® CBS-X (Sample D) is significantly whiter and brighter in standard lighting than liquid bleach with PVP alone (Sample B). Liquid bleach with FWA1 alone (Sample C) or PVP+FWA2 (Sample E) actually receive negative scores, indicating a lack of whiteness/brightness.

Scoring under ultraviolet lighting shows that liquid bleach with PVP+FWA Tinopal ® CBS-X (Sample D) is brighter than the other samples, and that the three samples containing FWA (Samples C, D & E) are significantly brighter than the sample with PVP alone (Sample B).

Other ingredients which can be employed in liquid bleach can be substituted for or added to the above. For example, other peracid bleaches such mononylamido peroxysuccinic acid ("NAPSA"), sulfone peroxyacids, and N-decanoyl-6-amino-peroxycaproic acid can be used. Any bleach-compatible surfactants can be substituted for the linear alkylbenzene sulfonic acid, such as sodium alkyl sulfate and sodium alkyl ethoxy sulfate. Surfactant and hydrotrope are optional in the formula. Other hydrotropes, such as sodium xylene sulfonate, can be used. Other chelants, such as diphosphonate, tetrasodium pyrophosphate, and ethylene diamine tetraacetate, can be substituted for the dipicolinic acid.

EXAMPLE IV

A composition of the present invention is prepared by mixing together the following ingredients in the order shown:

| Component | Weight % |
|---|---|
| Distilled, deionized water | 40.00 |
| Mononononylamido peroxyadipic acid | 10.19 |
| $C_{12-13}$ Linear alkylbenzene sulfonic acid | 1.00 |
| 2,6 Pyridinedicarboxylic acid | 0.25 |
| Sodium sulfate | 8.30 |
| Magnesium sulfate *7 $H_2O$ | 7.41 |
| Sodium toluene sulfonate | 1.73 |
| Polyvinyl pyrrolidone (MW 10,000) | 1.89 |
| FWA (Tinopal ® CBS-X) | 0.25 |
| Sodium hydroxide | 0.25 |
| Water, distilled and deionized | Balance |

EXAMPLE V

A composition of the present invention is prepared by mixing together the following ingredients in the order shown:

| Component | Weight % |
|---|---|
| Distilled, deionized water | 40.00 |
| Mononononylamido peroxyadipic acid (60% active) | 16.92 |
| 2,6 Pyridinedicarboxylic acid | 0.24 |
| $C_{12-13}$ Linear alkylbenzene sulfonic acid | 1.01 |
| Sodium sulfate | 7.19 |
| Magnesium sulfate *7 $H_2O$ | 6.42 |
| Sodium toluene sulfonate | 1.67 |
| Polyvinyl pyrrolidone (MW 10,000) | 1.82 |
| FWA (Tinopal ® CBS-X) | 0.10 |
| Xanthan gum | 0.15 |
| Sodium hydroxide | 3.32 |
| Water, distilled and deionized | 21.16 |

100 ml of the above bleach composition is added to each load of laundry wash water, along with ½ cup (66.40 grams-dosage) of the following granular detergent composition.

| Component | Weight % |
|---|---|
| Sodium 12.3 linear alkyl benzene sulfonate | 12.60 |
| Sodium $C_{14}$–$C_{15}$ alkyl sulfate | 6.20 |
| Citric acid | 3.50 |
| Zeolite A, hydrate (1–10 micron size) | 26.30 |
| Sodium carbonate | 20.53 |
| Sodium silicate (1.6 ratio $NaO/SiO_2$) | 2.29 |
| Polyethylene glycol (MW 8,000) | 1.73 |
| Sodium polyacrylate (MW 4,500) | 3.39 |
| Protease enzyme* | 0.0164 |
| Sodium perborate monohydrate | 0.82 |
| Sodium sulfate | 10.33 |
| Balance (including water, brightener, perfume suds suppressor) | to 100.00 |

*Activity of 1.8 Anson units per gram.

Alternatively, 100 ml of the above bleach composition is added to each load of laundry wash water, along with ½ cup (131 grams) of the following liquid detergent composition.

| Component | Weight % |
|---|---|
| $C_{14-15}$ alkyl polyethoxylate (2.25) sulfonic acid | 8.43 |
| 1,2-Propanediol | 4.50 |
| Monoethanolamine | 1.05 |
| $C_{12-13}$ alcohol polyethoxylate (6.5)* | 3.37 |
| $C_{13}$ linear alkylbenzene sulfonic acid | 8.43 |
| Ethanol | 1.18 |
| Sodium hydroxide | 3.30 |
| Sodium toluene sulfonate | 2.91 |
| $C_{12-14}$ fatty acid | 0.50 |

-continued

| Component | Weight % |
|---|---|
| Citric acid | 3.37 |
| Sodium/calcium formate | 0.41 |
| $C_{12}$ alkyltrimethylammonium chloride | 0.51 |
| Tartrate succinate** | 3.37 |
| TEPA-$E_{15-18}$ *** | 1.48 |
| Protease enzyme* | 0.0076 AU/g |
| Water, brightener, perfume and minors | to 100.00 |

*Alcohol and monoethoxylated alcohol removed.
**80:20 mix of TMS:TDS per U.S. Pat. No. 4,663,071.
***Tetraethylene pentaimine ethoxylated with 15–18 moles (avg.) of ethylene oxide at each hydrogen site on each nitrogen.

EXAMPLE VI

A bleach composition of the present invention with PVA & FWA is as follows.

| Component | Weight % |
|---|---|
| Distilled, dionized water | 40.00 |
| Monononylamido peroxyadipic acid | 20.40 |
| 2,6 Pyridinedicarboxylic acid | 0.25 |
| Sodium sulfate | 8.30 |
| Magnesium sulfate *7 $H_2O$ | 7.41 |
| Sodium toluene sulfonate | 1.73 |
| $C_{12-13}$ Linear alkylbenzene sulfonic acid | 1.00 |
| Xanthan gum | 0.15 |
| Polyvinyl pyrrolidone (MW 10,000) | 1.89 |
| FWA (Tinopal ® CBS-X) | 0.10 |
| Sodium hydroxide | 0.50 |
| Water, distilled and deionized | Balance |

EXAMPLE VII

Perfume ingredients are evaluated for stability when in direct contact with the unperfumed liquid bleach composition of Example V, using the following method.

(1) 25 g of the unperfumed bleach composition containing NAPAA is weighed into a 2 oz capacity screw-cap plastic bottle.
(2) 0.05 g (±0.005 g) of perfume ingredient is dropped into the product from a disposable pipette to give a perfume level of 0.2% (±0.02%).
(3) The bottle is then capped and shaken vigorously for ten to fifteen seconds.
(4) After storage at room temperature, the samples are evaluated by an expert perfumer using the following scales for perfume intensity and character.

Perfume Intensity Scale

1=there is no perfume
2,3=I think there is no perfume
4,5=I think there is perfume
6=there is perfume
7,8,9=there is a strong perfume (where 9=the strongest)

Perfume Character Scale

A=indistinguishable from fresh perfume character as applied to product
B=slightly different from fresh perfume character
C=obviously changed from fresh perfume character, but still usable
D=Different from fresh perfume character, not usable.

The results are as follows:

| Perfume Ingredient | 1 Month Stability Grade |
|---|---|
| dodecahydrotetramethylnapthofuran (50% in Shellsol T) | 7A |
| methyl-2,2-dimethylbicyclo-(2.2.1)-heptane-3-carboxylate | 9C |
| 4-isopropylbenzonitrile | 9A |
| 2-heptyltetrahydrofuran | 8A |
| 2-methyl-decanonitrile | 9A |
| 3,5,5-trimethylhexylacetate | 8A |
| 2-4-dimethyl-6-phenyldihydropyran | 9A |
| 2,4,dimethyl-4-phenyl tetrahydrofuran | 9A |
| 5-acetyl-3-isopropyl-1,1,2,6-tetramethylindane | 7A |
| phenylethyl iso-pentyl-ether | 9B |
| phenylethyl n-butyl ether | 9A |
| 1-ethoxy-1-phenylethoxy ethane | * |
| 3-methyldodecanonitrile | 9A |
| N-methyl-N-phenyl-2-methyl butyramide | 6A |
| 2-tertiary-butylcyclohexyl acetate | 9B |
| tridecene-2-nitrile | 9A |
| amyl salicylate | 8A |
| fenchyl alcohol | 9A |
| iso bornyl acetate | 9A |
| 2-methyl-3-(2-pentenyl)-2-cyclopenten-1-one | 8B |
| methyl cedrylone | 8A |
| bicyclo(2,2,1)heptane,2-ethyl-5-methoxy | 9A |
| Cistus Biocolorless | 9A |
| 3-cyclopentene-1-acetonitrile,2,2,3-trimethyl | 7B |
| cyclohexanepropanol,2,2,6-trimethyl-alpha-propyl, | 9A |
| 1,3-dioxolane,2-hexyl | 8B |

*Test discontinued after 1 week because of grade of 7D.

EXAMPLE VIII

A perfume composition is as follows:

| Ingredient | Wt. % |
|---|---|
| amyl salicylate | 43.00 |
| fenchyl alcohol | 1.00 |
| iso bornyl acetate | 20.00 |
| 2-methyl-3-(2-pentenyl)-2-cyclopenten-1-one | 1.00 |
| methyl cedrylone | 30.00 |
| sino citryl (compounded specialty perfume) | 5.00 |
| Total | 100.00 |

The above perfume composition, which contains 95% by weight of perfume ingredients having a stability grade of 7A or higher after one month, and 94% by weight of ingredients having a stability grade of 8A or higher after one month, as described in Example VIII, is mixed at a level of 0.2% by weight directly into the liquid bleaching composition of Example V to provide a perfumed composition of the present invention.

What is claimed is:

1. An aqueous liquid bleach composition comprising, by weight:

(a) from 5 to 15 weight % of mononylamido peroxyadipic acid;
(b) from about 0.4 to about 10 weight % of polyvinyl pyrrolidone with a molecular weight between about 5,000 and about 100,000; and
(c) from about 0.05 to about 2 weight % of a fluorescent whitening agent of the formula:

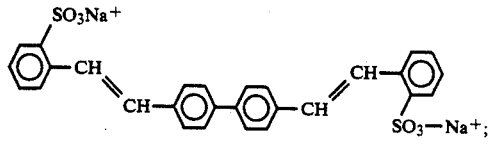

and wherein the ratio of polyvinyl pyrrolidone to fluorescent whitening agent is between about 20:1 and about 1:1, and the composition has a pH at 20° C. of from about 1 to about 6.5.

2. A liquid bleach composition according to claim 1 further comprising from 0.1 to 2 weight % of anionic or nonionic surfactant.

3. A liquid bleach composition according to claim 2 further comprising from about 3 to about 30 weight % of alkaline metal and alkali earth salts of sulfate or borate.

4. A liquid bleach composition according to claim 3 wherein the composition has a pH of from about 2.5 to about 5.5.

5. A liquid bleach composition according to claim 4 wherein the anionic or nonionic surfactant is selected from the group consisting of $C_{9-20}$ linear alkylbenzene sulfonate, $C_{12-20}$ alkyl sulfate, $C_{12-20}$ alkyl ether sulfate, $C_{8-18}$ alkenyl carboxysulfonate, $E_{2-20}$ ethoxylated $C_{10-20}$ alcohol, polyhydroxy $C_{10-20}$ fatty acid amide, and mixtures thereof.

6. A liquid bleach composition according to claim 5 wherein the mononylamido peroxyadipic acid has an average particle size of from about 30 to about 60 microns.

7. A liquid bleach composition according to claim 6 wherein the polyvinyl pyrrolidone: fluorescent whitening agent ratio is between 10:1 and 3:1.

8. A liquid bleach composition according to claim 7 comprising from about 5 to about 25 weight % of magnesium sulfate and sodium sulfate.

9. A liquid bleach composition according to claim 7 further comprising from about 0.01 to about 1 weight % of a perfume comprising perfume ingredients selected from the group consisting of dodecahydrotetramethylnapthofuran, methyl-2,2-dimethylbicyclo(2,2,1)-heptane-3-carboxylate, 4-isopropylbenzonitrile, 2-heptyltetra-hydrofuran, 2-methyl-decanonitrile, 3,5,5-trimethylhexylacetate, 2-4-dimethyl-6-phenyldihydropyran, 2,4,dimethyl-4-phenyl tetrahydrofuran, 5-acetyl-3-isopropyl-1,1,2,6-tetramethylindane, phenylethyl iso-pentyl-ether, phenylethyl n-butyl ether, 3-methyldodecanonitrile, 2-tertiary-butylcyclohexyl acetate, tridecene-2-nitrile, amyl salicylate, fenchyl alcohol, iso bornyl acetate, 2-methyl-3-(2-pentenyl)-2-cyclopenten-1-one, methyl cedrylone, bicyclo(2,2,1)heptane,2-ethyl-5-methoxy, 3-cyclopentene-1-acetonitrile,2,2,3-trimethyl, cyclohexanepropanol, 2,2,6-trimethyl-alpha-propyl, and 1,3-dioxolane,2-hexyl.

10. A liquid bleach composition according to claim 9 comprising from about 20 to about 90 weight % of distilled, deionized water.

11. A stable liquid bleach composition according to claim 4 further comprising from about 0.05 to about 3 weight % of xanthan gum and from about 0.2 to about 15 weight % of anionic or nonionic surfactant; the composition being without cellulose derivatives or polyvinyl alcohol or chloride.

12. A stable liquid bleach composition according to claim 11 wherein the composition comprises from about 0.2 to about 1.5 weight % of $C_{10-14}$ inear alkylbenzene sulfonate.

13. A stable liquid bleach composition according to claim 12 wherein the composition has a viscosity of from 80 to 450 cps at 20° C.

14. A stable liquid bleach composition according to claim 2 comprising, by weight of the composition:

a. 0.05–3% xanthan gum;
b. 5–15% mononylamido peroxyadipic acid of average particle size from about 30 to about 60 microns;
c. 0.2–1.5% nonionic or anionic surfactant;
d. 0.01–0.5% chelant;
e. 7–15% sodium sulfate and magnesium sulfate;
f. 1–5% hydrotrope;
g. 0.5–5% polyvinyl pyrrolidone with molecular weight between 10,000 and 20,000;
h. 0.05–2% fluorescent whitening agent of the formula:

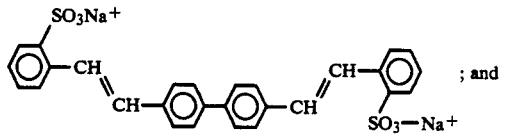

; and i. balance distilled deionized water; wherein the pH at 20° C. of the composition is between 3.5 and 4.5.

15. A method for cleaning and bleaching fabrics in the wash by contacting the fabrics with effective amounts of a detergent cleaning composition and an aqueous liquid bleach additive comprising, by weight:

(a) from 5 to 15 weight % of monononylamido peroxyadipic acid;
(b) from about 0.4 to about 10 weight % of polyvinyl pyrrolidone with a molecular weight between about 5,000 and about 100,000; and
(c) from about 0.05 to about 2 weight % of a fluorescent whitening agent of the formula:

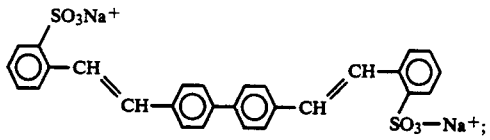

and wherein the ratio of polyvinyl pyrrolidone to fluorescent whitening agent is between about 20:1 and about 1:1, and the composition has a pH at 20° C. of from about 1 to about 6.5.

* * * * *